United States Patent [19]

Concannon et al.

[11] 4,446,383

[45] May 1, 1984

[54] REFERENCE VOLTAGE GENERATING CIRCUIT

[75] Inventors: Michael P. Concannon, Jericho; Charles K. Erdelyi, Essex, both of Vt.

[73] Assignee: International Business Machines, Armonk, N.Y.

[21] Appl. No.: 437,609

[22] Filed: Oct. 29, 1982

[51] Int. Cl.[3] ..... G05F 3/16

[52] U.S. Cl. ..... 307/297; 323/313

[58] Field of Search ..... 307/297, 304, 491; 323/313, 314, 317

[56] References Cited

U.S. PATENT DOCUMENTS

| | | | |
|---|---|---|---|
| 3,806,742 | 4/1974 | Powell | 307/297 X |
| 3,970,875 | 7/1976 | Leehan | 307/304 |
| 4,016,434 | 4/1977 | DeFillippi | 307/297 |
| 4,135,125 | 1/1979 | Oura | 307/297 X |
| 4,158,804 | 6/1979 | Butler et al. | 307/297 X |
| 4,300,061 | 11/1981 | Mihalich et al. | 307/297 |

OTHER PUBLICATIONS

Hansen, "Voltage Regulator", *IBM Tech. Discl. Bull.;* vol. 14, No. 4, pp. 1050; 9/1971.

IBM TDB Article, "Low Output Impedance Reference Voltage," Spina et al., vol. 22, No. 11, Apr. 1980, pp. 5017–5018.

IBM TDB Article, "Voltage Reference Circuit," R. S. Becker, vol. 23, No. 5, Oct. 1980, pp. 1840–1841.

*Primary Examiner*—Larry N. Anagnos

*Attorney, Agent, or Firm*—Otto Schmid, Jr.

[57] ABSTRACT

A reference voltage generating circuit comprising a depletion mode FET transistor connected to provide a constant current source coupled between a supply voltage and an output node. Three serially connected enhancement mode FET transistors are connected between the output node and a reference voltage. The first enhancement mode device is diode coupled to provide an enhancement threshold voltage offset, the second enhancement mode device has its gate electrode connected to the supply voltage to compensate for variations in supply voltage and the third enhancement device has its gate electrode connected to a source follower circuit. The source follower circuit comprises two serially connected depletion mode devices which receive an input from the output node and provide a feedback output to the gate electrode of the third enhancement mode device so that a constant voltage of a predetermined magnitude is maintained at the output node.

5 Claims, 3 Drawing Figures

REFERENCE VOLTAGE GENERATING CIRCUIT

DESCRIPTION

BACKGROUND OF THE INVENTION

1. Field of the Invention

This invention relates to a voltage reference circuit and more particularly to a voltage reference circuit comprising a plurality of FET devices on a semiconductor chip.

2. Description of the Prior Art

There are a number of circuit application areas that require a constant reference voltage, and these areas include voltage regulators, analog comparators, A/D converters, phase lock loops, etc. In bipolar transistor technology, a constant voltage source can be easily provided by using the breakdown characteristics of a p-n junction. However, generation of precise reference voltages in FET technology is particularly challenging because forward biased or avalanching junctions are not generally utilized in the normal functioning of FET devices.

Various voltage reference circuits have been developed for FET technology, and these circuits provide satisfactory operation for most applications. However, the drive toward greater circuit density has led to VLSI FET circuits characterized by large process variations and reduced voltage circuits for lowering power requirements. It was found that the existing FET voltage reference circuits do not provide the compensation for loading effects, compensation for power supply variations and compensation for processing parameter variations needed for the VLSI FET circuits.

SUMMARY OF THE INVENTION

It is therefore the principal object of this invention to provide a voltage reference circuit with increased degree of stability and dynamic range.

It is another object of this invention to provide an on-chip voltage reference circuit suitable for VLSI FET circuits.

In accordance with the present invention, there is provided a reference voltage generating circuit comprising a current source coupled between a source of input voltage and an output node, and a series circuit connected between the output node and a source of reference voltage. The series circuit includes a voltage offset means coupled to the output node and first and second current controlling devices in series between the voltage offset means and the source of reference voltage. The control electrode of the first current controlling drive is coupled to the source of input voltage. A source follower is connected with its input terminal connected to the output node and its output terminal connected to the control electrode of the second current controlling device. The circuit produces a constant reference voltage at the output node.

The devices comprise both depletion and enhancement mode FET devices and in a specific embodiment the devices are n-channel devices.

The foregoing and other objects, features and advantages of the invention will be apparent from the following more particular description of a preferred embodiment of the invention as illustrated in the accompanying drawings.

DESCRIPTION OF THE PREFERRED EMBODIMENT

Figure 1:
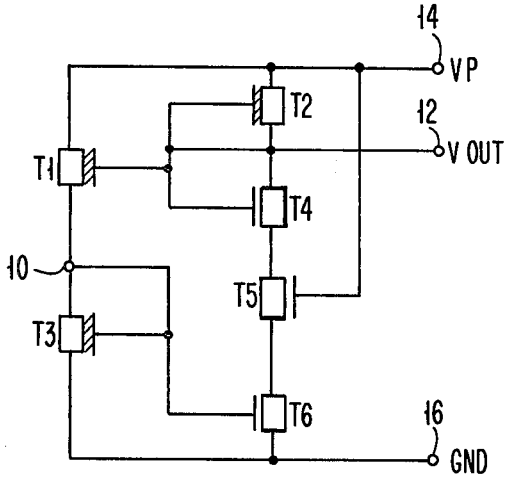
FIG. 1 is a schematic diagram of the voltage reference circuit.
Figure 2:
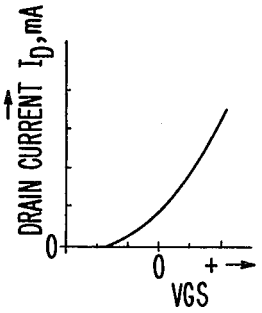
FIG. 2 is a graph showing typical transfer characteristics for an n-channel depletion-type MOS FET.
Figure 3:
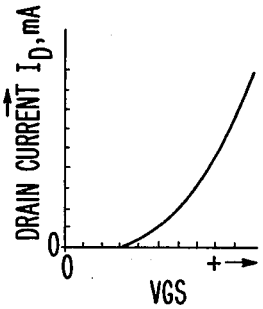
FIG. 3 is a graph showing typical transfer characteristics for an n-channel enhancement type MOS FET

The voltage reference circuit is fabricated with both enhancement and depletion mode IG FET devices, and the circuit is shown in FIG. 1. Both the enhancement and depletion mode devices are n-channel devices. The typical transfer characteristics shown in FIG. 2 indicate that the n-channel depletion mode devices are normally ON (gate-source voltage=0), and the transfer characteristics shown in FIG. 3 indicate that the n-channel enhancement mode devices are normally OFF (gate-source voltage=0).

The circuit includes a first depletion mode transistor T1 having its drain connected to a source 14 of positive supply voltage VP, its source connected to a first node 10, and its gate connected to an output node 12.

A second depletion mode FET transistor T2 has its drain connected to the positive supply voltage VP, its source connected to the output node 12, and its gate connected to its source.

A third depletion mode FET transistor T3 has its drain connected to the first node 10, its source connected to a source 16 of reference potential, and its gate connected to its drain.

A first enhancement mode FET transistor T4 has its drain connected to the output node 12, its source connected to a first intermediate point, and its gate connected to its drain.

A second enhancement mode FET transistor T5 has its drain connected to the first intermediate point, its source connected to a second intermediate point and its gate connected to the positive supply voltage VP.

A third enhancement mode FET transistor T6 has its drain connected to the second intermediate point, its source connected to the reference potential and its gate connected to the first node 10.

The circuit functions to produce a compensated reference voltage Vout at output node 12. The second depletion mode transistor T2 is connected between the positive supply voltage VP and the output node 12. The gate of this device is coupled to its source to provide a constant current source. Enhancement mode transistors T4, T5 and T6 are serially connected between the output node 12 and the reference potential (GND). The first enhancement mode transistor T4 in the serially connected branch is diode coupled to provide an enhancement threshold voltage offset. This voltage drop is dependent on process conditions. The second enhancement mode transistor T5 has its gate coupled to the supply voltage VP, and this transistor provides compensation for changes in the supply voltage VP. The variation in supply voltage VP is compensated by feedback based on the operation of transistor T5. Should the magnitude of supply voltage VP decrease, then, due to the gate connection, transistor T5 would conduct less to compensate for this variation. The opposite compensation would result from an increase in VP. Third enhancement device T6 provides negative feedback compensation for the output voltage Vout. The gate of T6 is driven by a pair of series connected depletion devices T1 and T3 in what amounts to a source follower arrangement. Transistor T1 is responsive to the voltage at the output node 12 so that changes in voltage at the output node are amplified and coupled to the gate of transistor T6 by way of the feedback path which includes depletion mode transistors T1 and T3.

Thus it can be seen that the circuit is operable to compensate for loading effects, for power supply variations and the specific inter-connection of the IGFET devices minimizes the effect of temperature and process parameter variations on the output voltage. In a specific embodiment, the devices were fabricated with the following dimensions:

| Device | W | L |
|---|---|---|
| T1 | 20μ | 3.6μ |
| T2 | 3.5 | 13.2 |
| T3 | 3.7 | 13.2 |
| T4 | 2.6 | 8.3 |
| T5 | 3.5 | 13.2 |
| T6 | 3.5 | 3.6 |

The circuit operated with a nominal supply voltage VP of 5 volts with a variation of from 4.5 to 5.5 volts. The resulting output voltage Vout was 3±0.1 volts.

While the invention has been particularly shown and described with reference to a preferred embodiment thereof, it will be understood by those skilled in the art that various other changes in the form and details may be made therein without departing from the spirit and scope of the invention.

Having thus described our invention, what we claim as new, and desire to secure by Letters Patent is:

1. A reference voltage generating circuit comprising a current source coupled between a source of input voltage and an output node;

a series circuit connected between said output node and a source of reference voltage, said series circuit including a voltage offset means coupled to said output node, a first current controlling device coupled to said voltage offset means and a second current controlling device coupled between said first current controlling device and said source of reference voltage; said first and said second current controlling devices each having a control electrode, means for coupling the control electrode of said first current controlling device to said source of input voltage;

a source follower circuit having input and output terminals, means for coupling the input terminal of said source follower circuit to said output node; and means for coupling the output terminal of said source follower circuit to said control electrode of said second current controlling device so that a constant reference voltage of a predetermined magnitude is produced at said output node.

2. The circuit of claim 1 wherein said current source comprises a FET device of the depletion mode type.

3. The circuit of claim 1 wherein said voltage offset means comprises a diode coupled FET device of the enhancement mode type.

4. The circuit of claim 1 wherein said first and said second current controlling devices comprise FET devices of the enhancement mode type.

5. The circuit of claim 1 wherein said source follower circuit comprises a first and a second FET devices of the depletion mode type serially connected between said source of input voltage and said source of reference voltage, said first FET device having a control electrode comprising said input terminal, and wherein said output terminal comprises the node between said first and said second serially connected FET devices.

* * * * *